United States Patent [19]

Osvald et al.

[11] 4,353,753

[45] Oct. 12, 1982

[54] CLEANING BOILER TUBES OF DIGESTING HEAT EXCHANGERS USED IN ALUM EARTH PROCESSING

[75] Inventors: Zoltan Osvald; Gergely Veres, both of Budapest; Gyula Odor, Mosonmagyarovar; György Lang; Janos Steiner, both of Budapest, all of Hungary

[73] Assignee: Magyar Aluminiumipari Troszt, Budapest, Hungary

[21] Appl. No.: 212,636

[22] Filed: Dec. 3, 1980

[51] Int. Cl.[3] ..... B08B 3/10

[52] U.S. Cl. ..... 134/22.13; 423/131

[58] Field of Search ..... 134/22.13, 22.15; 423/131

[56] References Cited

U.S. PATENT DOCUMENTS 1,194,542 8/1916 Raymond ..... 134/22.13

3,997,650 12/1976 Yamada et al. ..... 423/131 X

*Primary Examiner*—Richard V. Fisher

*Attorney, Agent, or Firm*—Karl F. Ross

[57] ABSTRACT

The invention relates to plant operations for increasing the cycle times of heat exchangers by the digestion of the aluminium oxide content of a slurry according to the Bayer technology, said slurry consisting of bauxite and sodium aluminate liquor, using an equipment in which the material is heated stepwise and in more parallel material streams, then the material streams are combined and further heated, or combined and kept at the same temperature, or after combination further heated and kept at the same temperature, characterized in that a part of the parallel material streams is slurry, another part of same is aqueous sodium hydroxide solution, preferably sodium aluminate liquor containing sodium hydroxide, or water, and the parallel material streams are exchanged in the heat exchangers in a cyclical manner.

4 Claims, 2 Drawing Figures

CLEANING BOILER TUBES OF DIGESTING HEAT EXCHANGERS USED IN ALUM EARTH PROCESSING

FIELD OF THE INVENTION

The invention relates to a method of cleaning the boiler tubes of digesting heat exchangers used in alum earth processing by Bayer technology.

BACKGROUND OF THE INVENTION

In the course of Bayer alum earth processing technology the alum earth containing mineral is mixed with sodium hydroxide and the alum earth is digested using a line consisting of preheaters and/or autoclaves, or in tube digesting equipment. Digesting equipment consisting of preheaters and autoclaves is disclosed in the Hungarian Pat. No. 149 514 and in the German Pat. No. 1 920 222. Upon heating the slurry in these types of equipment, at the slurry-side of the boiler tubes a deposit forms which must be removed from time to time. In case of equipment consisting of preheaters and autoclaves cleaning is performed by cyclic cut off of each unit, sometimes by cyclic putting out of each line, while for the mentioned tube digesting equipment cleaning is carried out by disconnecting one or more boiler tubes. Since frequent cleaning is inevitable for the efficient operation of the equipment, the possibility and manner of cleaning indicate up-to-dateness of the equipment.

The chemical composition of the deposit depends on the chemical composition of the alum earth containing mineral, but the amount of deposit is mainly determined by the silicates because of the silica which is always present in the starting mineral. In the methods disclosed in the above-mentioned patents the deposits are removed with the aid of a cleaning fluid, which method requires supplementary equipment at additional cost.

OBJECT OF THE INVENTION

The object of the invention is to provide a cleaning method by which the cleaning fluid is replaced by a part of the liquor used in the technological process.

SUMMARY OF THE INVENTION

According to the method of our invention it is only a part of the liquor that is admixed with the alum earth containing mineral before feeding the latter through the digesting line, and heating it in the form of slurry, the other part of the liquor is fed through the boiler tubes to be cleaned and heated to the digesting temperature together with the slurry flowing in other boiler tubes. Then at this temperature the slurry and the liquor used for cleaning are mixed together in a tube or tank under pressure, the mixture is permitted to stand, then cooled in a known way. The cleaned boiler tubes are filled again with slurry, other tubes previously operating with slurry are disconnected in order to clean them, and the liquor for cleaning is passed through and heated in these tubes.

Hence the invention also relates to plant operations for increasing the cycle times of heat exchangers by the digestion of the aluminum oxide content of a slurry according to the Bayer technology, said slurry consisting of an alum earth containing mineral and sodium aluminate liquor, using equipment in which the material is heated stepwise and in a number of parallel material streams, then the material streams are combined and further heated, or combined and kept at the same temperature, or after combination further heated and kept at the same temperature, such that a part of the parallel material streams is slurry, another part of same is aqueous sodium hydroxide solution, preferably sodium aluminate liquor, or water, and these parallel material streams are changed in the heat exchangers in a cyclical manner. The process operations of the invention can be carried out also in such manner that before uniting the material streams the slurry is in fluid form and the sodium aluminate liquor or water is partly in vapor phase.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
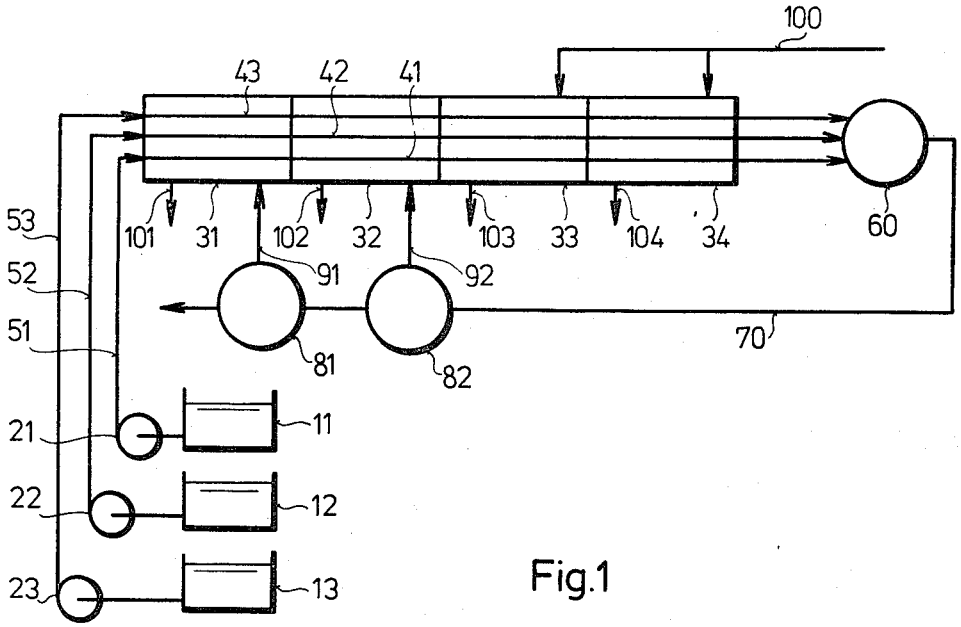
FIG. 1 is a flow diagram of a bauxite digestion plant according to the invention.

The arrangement of FIG. 1, showing a possible embodiment of the invention is applicable for digesting bauxites of gibbsite character. One of tanks 11, 12 and 13 serves as a holder for the digesting liquor while the others are for storing the slurry before digestion. The suction fittings of pumps 21, 22 and 23 are connected with the outlet pipe ends of tanks 11, 12 and 13, respectively, and the pressure sides of these pumps are connected through pipelines 51, 52 and 53 with the slurry ducts 41, 42 and 43 of the first preheater 31. Each one of the slurry ducts 41, 42 and 43 may consist of one boiler tube or a bundle of boiler tubes; in the latter case proper pipe angles are incorporated into pipelines 51, 52 and 53. Slurry ducts 41, 42 and 43 are led through preheaters 31 and 32, heated by expansion steam, then through preheaters 33 and 34, heated by fresh steam or another heat carrier, then led into a reactor 60, which is connected by slurry duct 70 with expansion vessels 82 and 81 in succession and the slurry treating equipment. The steam spaces of expansion vessels are connected with the heating spaces of preheaters 31 and 32, respectively, by expansion steam pipelines 91 and 92, respectively. Fresh steam pipeline 100 is linked with the heating spaces of preheaters 33 and 34. Return water discharge pipes 101, 102, 103 and 104 are connected with heating spaces of preheaters 31, 32, 33 and 34, respectively.

The process operations are performed as follows:

A slurry at a temperature of 90° C. is fed in tanks 11 and 12 continuously or intermittently, and digesting liquor of temperature 90° C. is filled in tank 13. Pumps 21, 22 and 23 force these materials continuously through pipelines 51, 52 and 53 to slurry ducts 41, 42 and 43, tho materials are heated up to a temperature of 100° C. in preheater 31, then mixed in reactor 60. Reactor 60 has such a large volume that the material flowing into it has a residence time of two hours before flowing further through slurry duct 70. This stage of the process is called keeping the material at the same temperature. During this time the digestion becomes complete. The digested slurry is practically at a temperature of 140° C. when it reaches the expansion vessel 82, in which cools to 130° C., while the steam liberating from it is led through expansion steam duct 92 to the heating space of preheater 32. The slurry flows further to expansion vessel 81, in which cools to 120° C., and again steam is liberated from it, which latter serves for heating preheater 31. Then the slurry leaves the digesting system and is subjected to further processing.

In slurry ducts 41 and 43 after some days of operation a deposit forms, which impairs the heat transfer. Then the materials in tanks 11 and 13 are exchanged. The slurry to be digested is fed into tank 13 while the pure digesting liquor is fed into tank 11 and the operations are continued this way. After some days a further exchange is carried out, the pure digesting liquor is fed into tank 12, the slurry to be digested is fed into tank 11 and the operations are continued this way. After some more days the pure digesting liquor is again filled into tank 13 and the slurry to be digested is fed in tank 12 hence the first step of the process is repeated. If these exchanges are performed regularly, the digesting liquor always removes the deposits from the slurry in slurry ducts 41, 42 and 43 of the preheaters.

Figure 2:
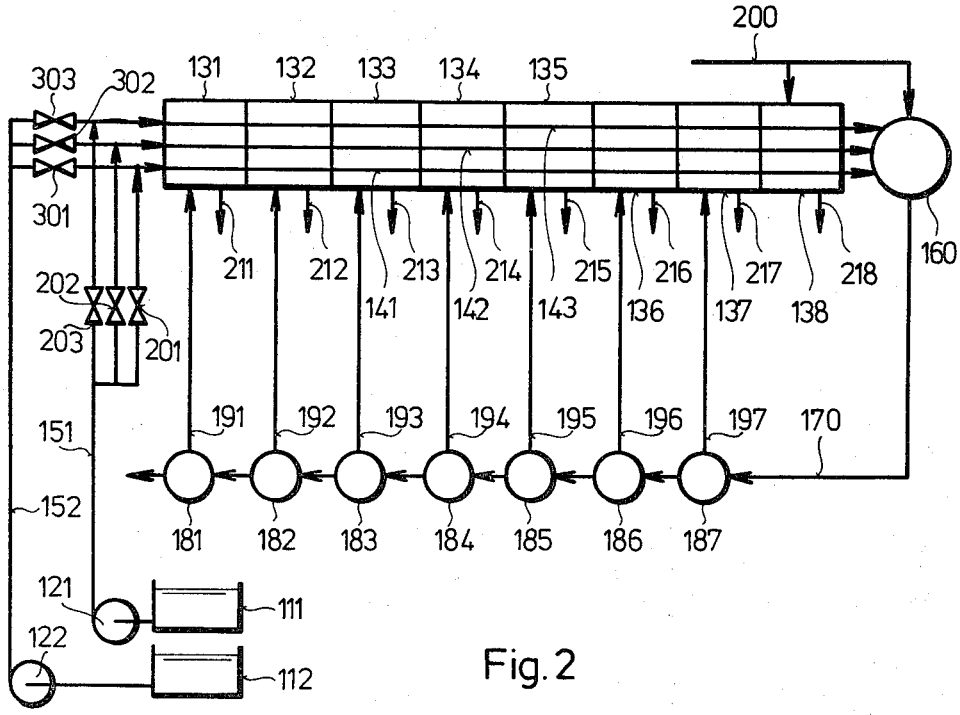
FIG. 2 is a flow diagram of another plant embodying the invention.
Figure 1:
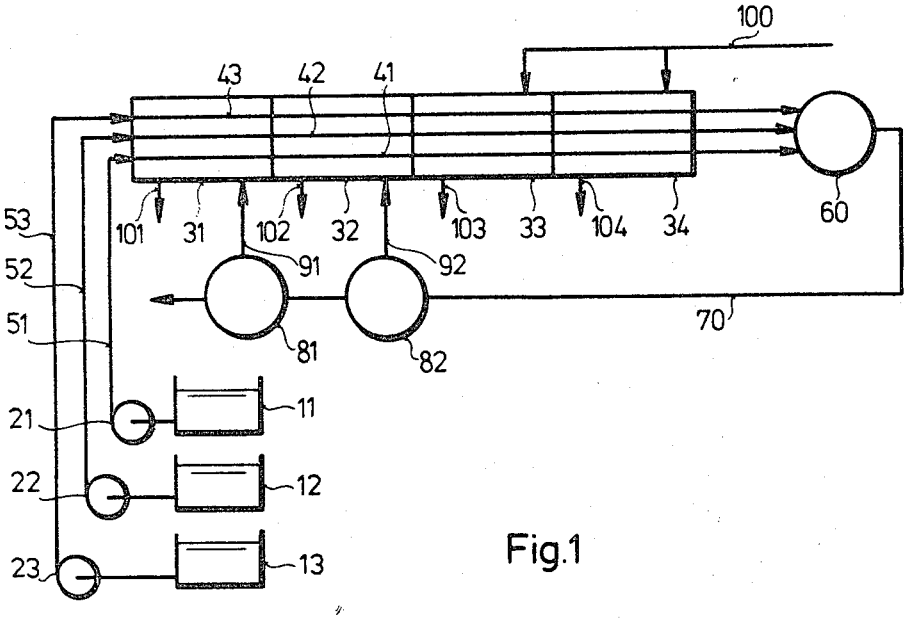
Figure 2:
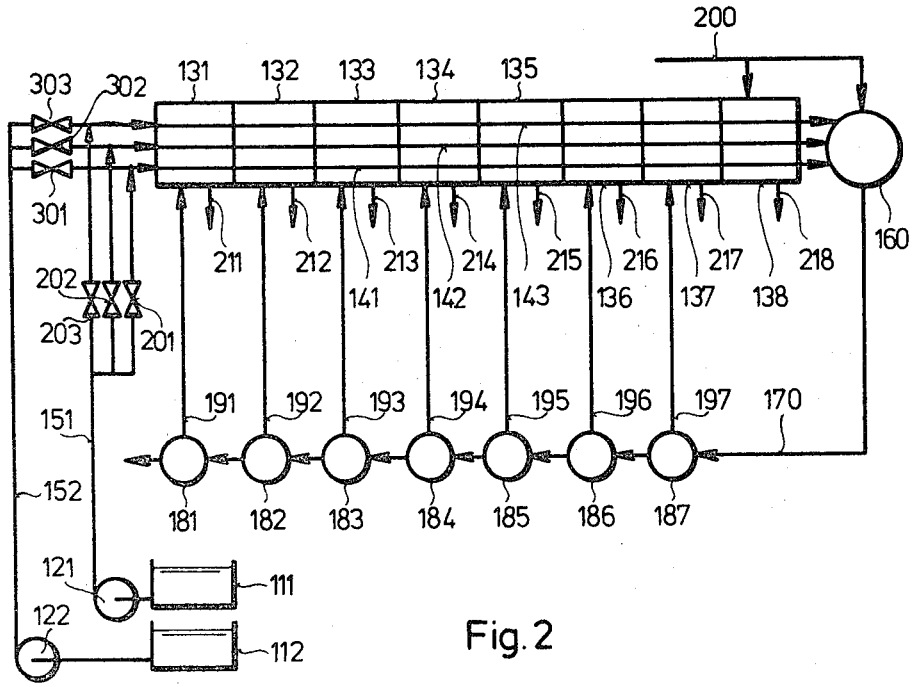

The arrangement of FIG. 2 is applicable for digesting bauxites of böhmite character. Tank 111 stores the slurry to be digested, tank 112 holds the digesting liquor. Pumps 121 and 122 are connected with tanks mentioned above. Both of pressure fittings 151 and 152 of the pumps ramify in a number—in our example in three—of directions, and each branch of each pressure fitting bears a valve. In our example these valves are shown at 201, 202, 203, 301, 302 and 303. Each two corresponding pipe are connected after the valve, i.e. the pipe after valves 201 and 301 leads to slurry duct 141, the pipe after valves 202 and 302 is led to slurry duct 142, while the pipe after valves 203 and 303 ends in slurry duct 143. The three slurry ducts 141, 142 and 143 lead along eight cascaded preheaters 131, 132, 133, 134, 135, 136, 137 and 138 and end in the reactor 160. Slurry duct 170 links reactor 160 with the line consisting of expansion vessels 187, 186, 185, 184, 183, 182 and 181, then with the slurry processing equipment. The steam spaces of expansion vessels 181, 182, 183, 184, 185, 186 and 187 are connected by expansion steam pipes 191, 192, 193, 194, 195, 196, and 197 with the heating spaces of corresponding preheaters 131, 132, 133, 134, 135, 136 and 137. The heating spaces of preheater 138 and the reactor 160 are connected with the fresh steam pipe 200. Each of the heating spaces of preheaters 131, 132, 133, 134, 135, 136, 137 and 138 is furnished with a return water dicharge 211, 212, 213, 214, 215, 216, 217 and 218.

The operations are performed as follows:

Digesting liquor is filled in tank 111 and slurry to be digested is filled in tank 112 continuously or intermittently. Both fluids are of about 90° C. temperature. The valves 201, 302 and 303 are open, the other valves are closed. This is the first cycle. Pump 122 transfers the slurry to be digested continuously to slurry ducts 142 and 143, pump 121 transfers the digesting liquor continuously to slurry duct 141. The digestion begins in slurry ducts 142 and 143, the digesting liquor solves the deposit formed in the previous cycle in slurry duct 141. At the end of the preheating line the slurry flow unites with the digesting liquor flow in the heated 160 reactor and the digestion is completed there. The slurry flows further through slurry duct 170 and expansion vessels 187, 186, 185, 184, 183, 182 and 181 under the same conditions as in the previous example, naturally under different pressure and temperature conditions. After some days or some hours operation valves 201 and 302 are closed and valves 202 and 301 are opened, and the second cycle begins, then valves 202 and 303 are closed and valves 203 and 302 are opened, and this is the third cycle.

In reactors 60 and 160 the pressure maintained is usually higher than the pressure corresponding to the saturation temperature of the slurry. If the pressure in reactors 60 and 160 corresponds to the saturation pressure of the slurry, then the cleansing fluid having a lower boiling point rise reaches the reactor in fluid-vapor phase, and the process operations according to the invention can also be carried out.

Using the process operations of our invention the cleansing fluid takes part in the digestion process and provides the same digestion effect as if it had been mixed with the bauxite or the slurry before preheating. At the same time it removes the deposits freshly formed from the slurry, hence the heat transfer capacity of the equipment remains unchanged for a longer time and so the digesting equipment can be operated without stopping for a substantially longer time. This fact makes the operation of the whole alumina plant more steady and a part of the maintenance costs can be saved.

What is claimed is:

1. A method of operating a plant for digesting aluminum oxide in a sodium aluminate liquor, said method comprising the steps of:

(a) passing a slurry of aluminum oxide mineral in a sodium aluminate liquor through a plurality of tubes of at least one tube-type digester while heating said tubes of said digester and recovering digestion liquor downstream from said digester;

(b) passing a cleaning liquid selected from the group which consists of sodium aluminate liquor, sodium hydroxide solution and water through at least one other tube of said digester while the latter is heated concurrently with the other tubes thereof and other tubes of said digester conduct said slurry therethrough and recovering the heated cleaning liquid downstream of said digester, whereby deposits formed in the tube traversed by the cleaning liquid during previous passage of slurry therethrough, are dissolved in the cleaning liquid;

(c) cyclically applying step (b) to each of the tubes of the digester while conducting said slurry as in step (a) through each tube previously subjected to step (b); and (d) combining the digestion liquid with the cleaning liquid recovered from step (b).

2. The method defined in claim 1 wherein, prior to combining in step (d), the cleaning liquid is partly in a vapor phase.

3. The method defined in claim 1 wherein said cleaning liquid is a sodium aluminate liquor containing sodium hydroxide.

4. The method defined in claim 1 wherein subsequent to step (d) the combined digestion liquor and cleaning liquid is heated.

* * * * *